US008878038B1

(12) United States Patent
Shumaker

(10) Patent No.: US 8,878,038 B1
(45) Date of Patent: Nov. 4, 2014

(54) ADJUSTABLE PERCUSSION MOUNTING

(71) Applicant: Laurence B. Shumaker, Malvern, PA (US)

(72) Inventor: Laurence B. Shumaker, Malvern, PA (US)

( * ) Notice: Subject to any disclaimer, the term of this patent is extended or adjusted under 35 U.S.C. 154(b) by 0 days.

(21) Appl. No.: 13/933,036

(22) Filed: Jul. 1, 2013

(51) Int. Cl.
*G10D 13/08* (2006.01)
*G10K 1/071* (2006.01)

(52) U.S. Cl.
CPC ..... *G10K 1/071* (2013.01)
USPC ..... 84/406

(58) Field of Classification Search
USPC ..... 84/402–410
See application file for complete search history.

(56) References Cited

U.S. PATENT DOCUMENTS

| | | | | |
|---|---|---|---|---|
| 461,458 | A * | 10/1891 | Vanduzen | 116/25 |
| 4,154,135 | A | 5/1979 | Haack | |
| 5,493,947 | A | 2/1996 | Philbeck | |
| 6,471,078 | B2 | 10/2002 | Pyle | |
| 6,640,742 | B1 * | 11/2003 | Grupp | 116/169 |
| 2008/0078278 | A1 | 4/2008 | Malta | |

* cited by examiner

*Primary Examiner* — Kimberly Lockett
(74) *Attorney, Agent, or Firm* — Caesar, Rivise, Bernstein, Cohen & Pokotilow, Ltd.

(57) ABSTRACT

A device for mounting a percussion instrument with a strap handle including a bracket mounted on a horizontal support bar, where the bracket has a pinion parallel to the support bar at and held at a fixed radial angle relative to the support bar, and an option pivot over the pinion to fit inside the handle of the instrument, such that the strap handle fits over the pinion and the instrument dangles from the pinion and is thus free to swing in the direction away from the bar but is blocked by the bar or the bracket from swinging in the direction of the bar.

12 Claims, 4 Drawing Sheets

ADJUSTABLE PERCUSSION MOUNTING

BACKGROUND OF THE INVENTION

1. Field of Invention

This invention relates to devices and systems for mounting percussion instruments, and particularly to the mounting of hand bells.

2. Description of Related Art

U.S. Pat. No. 5,493,947 (Philbeck) titled Support Device for an Acoustical Bell issued Feb. 27, 1996 discloses a device for supporting an acoustical bell comprising a base member carrying a channel. The channel is formed to receive the handguard of the bell so that the bell can be pivoted about its handguard. An alternative embodiment comprises a T-shaped base with a recess formed therein for receiving the handguard. Rotating the bell handle downward elevates the bell a distance above a surface so that the bell can be rung by striking it. A strip of felt or rubber can be placed in the channel as a cushion for the handguard.

U.S. Pat. No. 4,154,135 (Haack) titled Musical Instrument issued May 15, 1979 discloses a bell tower arranged to permit a single person to ring a substantial number of bells as in the playing of a musical selection. The bell tower includes a stand for supporting a plurality of bells suitably to be rung by the selective striking thereof as by a mallet or other ringing element. The instrument includes a control for selectively damping rung bells. The control may be foot pedal operated and may be arranged to damp selected groups of the bells of the tower. The bells may be supported on the tower stand to define octaves corresponding to the notes of a conventional piano keyboard. The respective octaves may be vertically related. The damping control may be biased to a damping disposition and selectively released by the user in the playing of the instrument.

U.S. Pat. No. 6,471,078 (Pyle) titled Mobile Percussion Instrument Field Rack System issued Oct. 29, 2002 discloses a mobile percussion-instrument field rack that holds a multiplicity of percussion instruments such that one or more percussionists can play at the same time. The field rack is foldable and easily transported, preferably in between the seats of a bus. It has large wide wheels attached to a center portion of the rack with a fixed stable wheelbase which is independent of swinging and height-adjustable side wings of the rack. It comprises a distinct upper and lower framework which utilizes a two-point clamping system for improved securing of the instruments.

U.S. patent application Ser. No. 11/533,427 (Malta) titled Bell Ensemble filed Sep. 20, 2006 and published as US 2008/0078278 A1 discloses a bell ensemble that includes individual bells affixed to one of two parallel rails of a support framework. In keyboard fashion, a series of bells representing natural-pitched notes of a musical scale (white piano keys) extends forwardly from the front rail while extending from a second rearward rail are those bells corresponding to the sharps or flats (black piano keys). In order to position the bells for greatest ease of striking by the musician, the rear framework support rail is offset upwardly relative to the front rail to place them closer to the musician. The framework is preferably held by a freestanding support such as a cymbal stand well-known in the percussion instrument arts.

A popular alternative for arraying instruments such as hand bells for performance is simply laying the instruments on a table and then lifting them when it is time to strike. This practice has certain drawbacks when working with larger instruments such as bass bells. Repeatedly lifting the instruments, which can cost several thousands of dollars, increases the risk of damaging to them. Further some instruments are not easily lifted, and this limits who can play them. For instance, the C2 bronze bass hand bell offered by Marlmark of Plumsteadville, Pa. is over 15 inches in diameter and weighs more than 14 pounds.

The support device described by Philbeck allows a bell to be sounded by striking it while it lies in a horizontal position in the support on a table. However the primary resonance of the bell in this position is perpendicular to the listening audience, resulting in a less pleasant perceived tone than when the bell is held vertically.

The Haack instrument, while convenient for keyboard manipulation of the bell choir, does not permit the same richness of artistry, ambience, or participation by many musicians, as the playing of the instruments by hand. The Malta bell ensemble and the Pyle mobile percussion instrument field rack, while convenient in many ways, do not address the particular certain issues of struck idiophones, such as convenient ways to suspend them for superior resonance during play by hand while preventing excessive motion away from the player. Nor do Haack, Pyle, or Malta provide a ready means for changing instruments quickly during a performance, as might be desirable, for example, to arrange a choir of instruments for play in a particular key either between pieces or even during a performance.

The entire disclosures of the patent publications discussed above are hereby incorporated by reference herein for all purposes

BRIEF SUMMARY OF THE INVENTION

One aspect of this invention is directed to a device for mounting a percussion instrument where the instrument has a strap handle. The device comprises a bracket having a mounting and a pinion. The mounting, which can take a variety of forms, provides a connection to a horizontal support bar at a fixed radial angle. The pinion is spaced from the bar and parallel to it. The strap handle fits over the pinion such that the instrument dangles from the pinion, and the instrument is free to swing in the direction away from the bar but is blocked by the bar or the bracket from swinging in the direction of the bar. Optionally, a pivot block fits over the pinion inside the handle and swings about the pinion with the instrument.

Another aspect of this invention is a system of an array of such devices used to suspend plural instruments. Preferably, in the system one or more horizontal support bars are used to support multiple instruments. The horizontal bars are in turn supported by pairs of vertical legs, and the pairs are joined by mid support members in an "A-frame" configuration. The legs may be footed with wheels or casters to permit easy movement of the entire structure. The vertical members may be detachable and/or fold flat to allow easy transport of the system.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF PREFERRED EMBODIMENTS OF THE INVENTION

Figure 1:
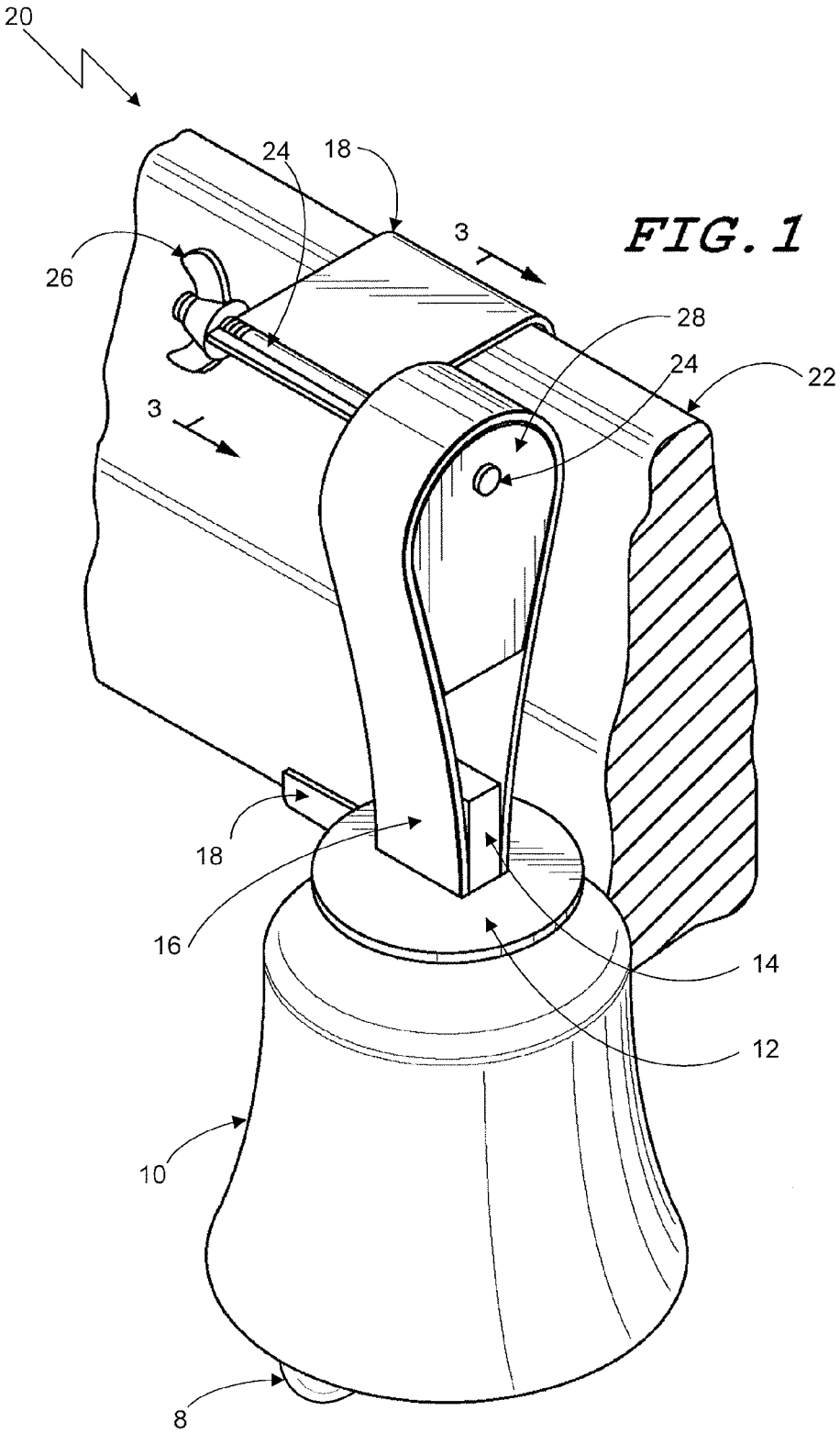
FIG. 1 is an isometric view of a hand bell mounted according to an aspect of the invention.

The inventive concepts include devices for the mounting of percussion instruments and systems for mounting multiple percussion instruments using such devices. FIG. 1 illustrates an exemplary device (20) which embodies some of the inventive concepts. In this illustration, the percussion instrument is a hand bell. The invention is equally applicable to many types of idiophones (musical instruments whose bodies resonate) that are struck or shaken and have handle straps or similar suspension loops, such as, but not limited to, cymbals, gongs, rattles, jingles, and chimes. The bell has: a body (10); a tang consisting of a horizontal circular portion (12) and a vertical portion (14) extending from the body (10); a handle (16) attached to the tang (14); and a moveable clapper (8) which dangles inside the body (10). The bell may be sounded by moving the body (10) such that clapper (8) swings to strike the body (10). Alternatively the bell may be sounded by it striking with a mallet (not shown) on the outside of the body.

In FIG. 1, the bell is mounted to a section of horizontal bar (22) by a bracket (18). Bracket (18) has a pinion (24) and a pivot (28) on the pinion and fitting inside the handle (16) of the bell. The bar (22) is depicted as being six-sided, but could take any shape, provided that it has a surface to which a bracket (18) may be affixed. It is preferred that bar (22) have at least one flat side to facilitate orienting the bracket (18) and keeping bracket (18) at a fixed radial angle relative to bar (22). While a flat-sided bar is preferred, it is noted that there are many potential alternatives. For example, a rod horizontal bar could have a deformation or hole to which the bracket may similarly be attached at a fixed radial angle.

It is preferable to use a horizontal bar, as opposed to a vertical bar or one set at angle, for at least the following reasons. First, a bar above the body of the instrument allows reasonably free travel of the instrument body when the instrument is played. (The position of the body of the bell below the horizontal bar is seen more clearly in FIG. 3 than in FIG. 1.) Second, a horizontal bar facilitates horizontal adjustment of the placement of the instrument. Third, a horizontal bar provides a convenient impediment to unwanted travel of the instrument away from the player. Fourth, a horizontal bar provides convenient mounting of multiple instruments, e.g., a choir of bells, in close proximity with a minimum of equipment.

Again referring to FIG. 1, the bracket (18) may be affixed to the bar (22) in any conventional way. For example, the bracket (18) may hang hooked over the bar (22) or be clamped to the bar (22) using a spring member or a tensioning screw. Preferably, the bracket (18) is itself sufficiently springy to allow it to be firmly affixed but easily moved horizontally along the bar to reposition the bell.

The pinion (24) is preferably parallel to the bar, as depicted here. The pinion (24) may be formed as an integral part of the bracket (18) or as a separate piece that is late attached to the bracket (18). Here the pinion (24) is depicted as a rod with a longitudinal slot and a threaded end. The body of bracket (18) extends through the slot. The pinion (24) is secured to the bracket by tension provided by wing nut (26). Alternatively, a separately formed pinion could be bolted, welded, or glued to the body of bracket (18). Any conventional means will do. E.g., the pinion could be compression fit into an aperture of bracket (18).

Note that the position of pinion (24) allows the bell to be swung up away from the bar as a player might do to sound the bell using the clapper (8). However, travel of the bell in the direction toward the bar is limited by the handle being blocked by the bar (22). This prevents the bell from swinging freely away from the player.

The pivot (28) fits inside handle (16) and over the pinion (24). The outer contour of pivot (28) fits the interior of the handle (16) of the instrument to be mounted. Handles vary considerably both in size and shape for percussion instruments. For example, a C4 bell, two octaves higher in pitch than a bass C2 bell, will be half the diameter and a fraction of the weight of the bass bell. It accordingly has a smaller handle. Pivots are preferable selected to approximately fit each instrument. Similarly, the spacing between the body of the bracket and the pinion may vary from instrument to instrument.

Figure 2:
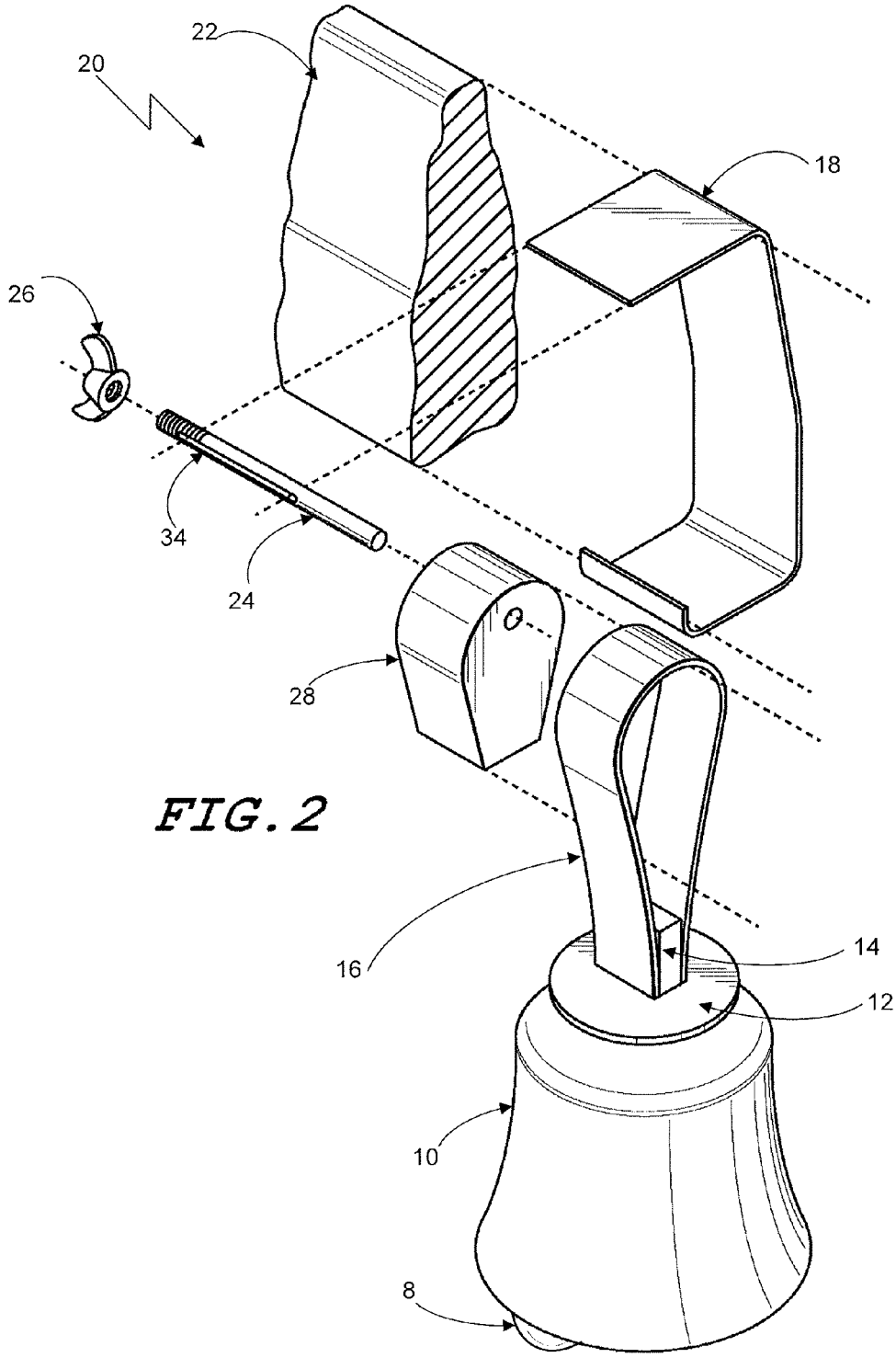
FIG. 2 is an exploded isometric view of a hand bell mounted according to an aspect of the invention.

FIG. 2 depicts the device (20) in exploded isometric view. Here more of bracket (18) is visible. Similarly the longitudinal slot (34) in pinion (24) is clearer, as are the out contours of pivot (28).

Figure 3:
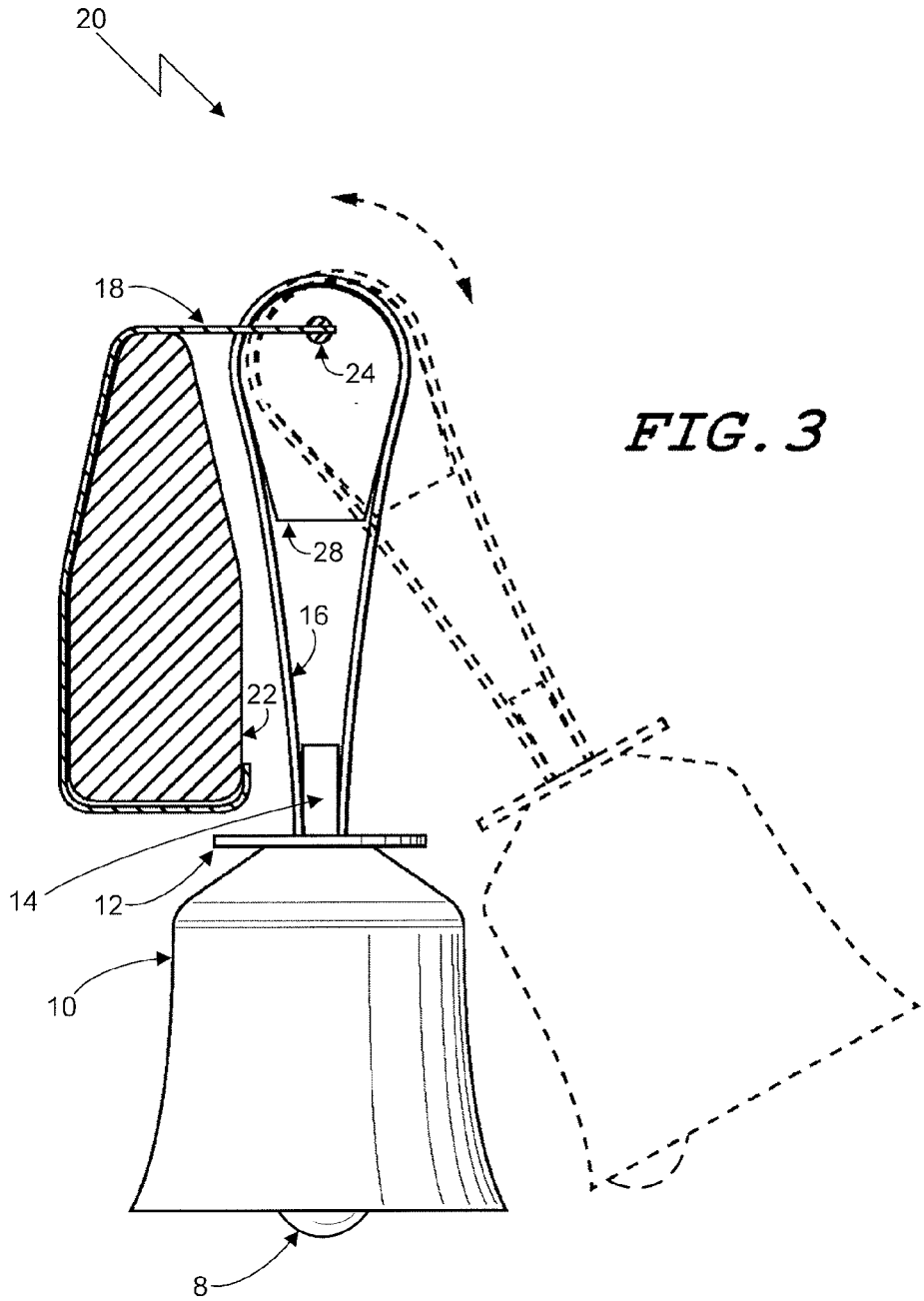
FIG. 3 is a sectional view taken along line 3-3 of FIG. 1 showing a hand bell mounted according to an aspect of the invention.

FIG. 3 is a sectional view of device (20) taken along line 3-3 of in FIG. 1. The bell in this figure is shown in two positions. It is depicted at rest with solid lines. The dashed lines show an alternative position of being raised to ring. At rest, clapper (8) will normally hang straight below its attachment point at the interface of bell body (10) with tang horizontal (12) and vertical (14) elements. When the bell is swung away from bar (22), the clapper (8) strikes the side of the body (10) and the bell sounds. Note that the bell is not free to swing as far in the opposite direction, as the handle (16) will come into contact with bar (22). The same advantage is seen when the bell is sounded by being struck with a mallet. Often handle (16) is made of leather or a natural or synthetic fabric or soft plastic, etc., such that contact between handle (16) and bar (22) does not lead to a loud sound. Alternatively, bar (22) or handle (16) can be provided with additional cushioning, e.g., a strip of felt, to inhibit unwanted sounding of the bell when it travels in the direction of bar (22).

Figure 4:
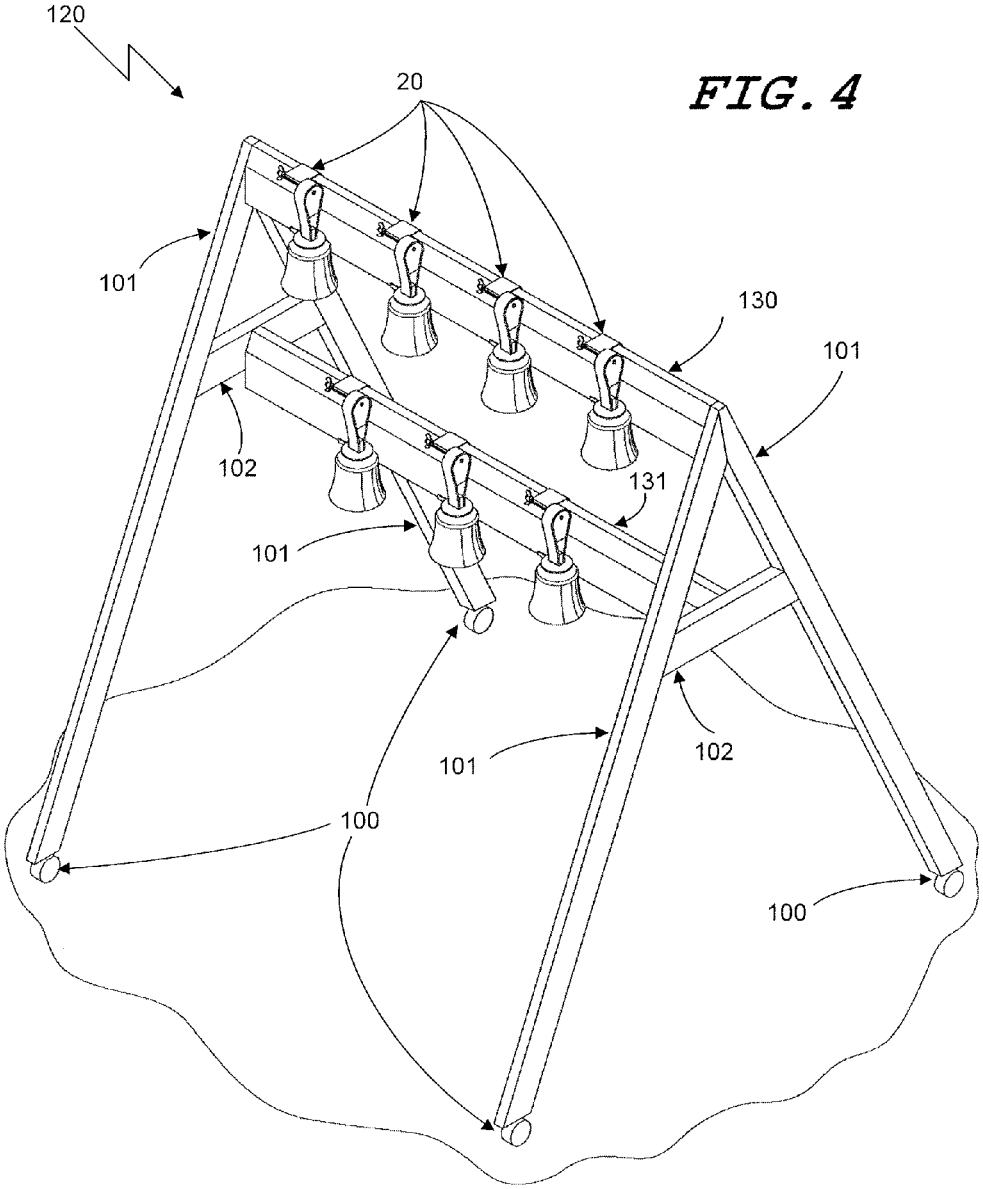
FIG. 4 is a depiction of a bell ensemble mounted on a portable rack system according to an aspect of the invention.

FIG. 4 depicts a system (120) for mounting plural percussion instruments according to an aspect of the invention. In FIG. 4, the instruments are again depicted as hand bells, and the mounting devices (20) are depicted according to the embodiment shown in FIGS. 1-3. An upper horizontal support bar (130) is attached to four vertical legs (101). The legs splay apart from each other at an angle, e.g., 10 degrees, off from vertical. There is a pair of legs (101) at each end of the bar (130), and each pair is joined by a mid-support member (102).

Four mounting devices (20) are shown on the upper bar (130). A lower bar (131) is shown with three mounting devices. For convenience during performance the legs (101) are optionally fitted with wheels or casters (100). The position of the bodies of the bells below the horizontal bar is seen more clearly in FIG. 3, e.g., than in FIG. 4.

To store or transport the system, the bells and mounting devices (20) are easily removed. The frame may be arranged to disassemble or fold in any conventional way. For example, the lower bar (131) may be lifted out of alignment brackets, not shown, which detachably secure it to the mid-support members (102). The upper bar (130) may similarly be lifted out of brackets detachably securing it to the legs (101). The mid-support members (102) may be attached by a pivot (not shown) at one leg (101) and hook onto a pin on the opposite leg (101). Each pair of legs (101) could be attached by a pivot at the apex of the A-frame formed with the associated mid-support member (102) such that when the mid-support member (102) is unhooked from one leg, the two legs (101) and mid-support member (102) may pivot to lie parallel to each other and be stored and moved lying parallel to the other pair of legs (101) and bars (130 and 131). Alternatively, the upper bar (130) may be pivotably attached to one or both pairs of legs and rotated to lie parallel with the legs (101) and other bar (131) in storage or transport.

FIG. 4 is just one example. The framework for supporting a number of percussion instruments using mounting devices (20) can take a variety of other forms as well. For example, rather than the A-frame style depicted in FIG. 4, the upper bar (130) and/or lower bar (131), or any number of bars, could extend as one-side cantilevers from a single vertical support post. Alternatively, one or more of the horizontal bars could extend to both side sides of the vertical post to form a "tree." The vertical post may be footed in any conventional manner, e.g. with stabilizer cross spars or a weighted disc, and may additionally be provided with wheels or casters.

While the invention has been described in detail and with reference to specific examples thereof, it will be apparent to one skilled in the art that various changes and modifications can be made therein without departing from the spirit and scope thereof.

I claim:

1. A device for mounting a percussion instrument where the instrument has a strap handle, the device comprising a bracket comprising a mounting and a pinion, wherein: the mounting provides a connection to a horizontal support bar at a fixed radial angle; the pinion is spaced from the bar and the pinion is parallel to the horizontal support bar; the strap handle fits over the pinion such that the instrument dangles from the pinion; and the instrument is free to swing in the direction away from the bar but is blocked by the bar or the bracket from swinging in the direction of the bar.

2. The device of claim 1 wherein a pivot block fits over the pinion inside the handle and swings about the pinion with the instrument.

3. The device of claim 1 wherein the percussion instrument is a hand bell.

4. The device of claim 2 wherein the percussion instrument is a hand bell.

5. The device of claim 1 wherein the percussion instrument is a bell, cymbal, gong, or chime.

6. The device of claim 2 wherein the percussion instrument is a bell, cymbal, gong, or chime.

7. The device of claim 1 wherein the horizontal support bar has one or more flat surfaces.

8. The device of claim 1 wherein the mounting comprises a spring member or a set screw.

9. A system for mounting percussion instruments comprising a plurality of the devices of claim 1 arranged on one or more horizontal support bars wherein the bars are held in place by stable vertical support members.

10. A system for mounting percussion instruments comprising a plurality of the devices of claim 2 arranged on one or more horizontal support bars wherein the bars are held in place by stable vertical support members.

11. The system of claim 9 wherein one or more support members is footed with wheels or casters to permit easy movement of the system.

12. The system of claim 9 wherein the vertical members are detachable and/or fold flat to allow easy transport of the system.

* * * * *